United States Patent [19]

Mattei et al.

[11] Patent Number: 4,600,020

[45] Date of Patent: Jul. 15, 1986

[54] DUAL-ROD CIGARETTE MANUFACTURING MACHINE

[75] Inventors: Riccardo Mattei; Bruno Belvederi, both of Bologna, Italy

[73] Assignee: G.D Societa' per Azioni, Bologna, Italy

[21] Appl. No.: 727,558

[22] Filed: Apr. 29, 1985

[30] Foreign Application Priority Data

May 4, 1984 [IT] Italy ..... 3450 A/84

[51] Int. Cl.[4] ..... A24C 5/14

[52] U.S. Cl. ..... 131/84.4; 131/84.1

[58] Field of Search ..... 131/84.4, 84.1

[56] References Cited

U.S. PATENT DOCUMENTS 4,336,812 6/1982 Seragnoli ..... 131/84.4

*Primary Examiner*—V. Millin

*Attorney, Agent, or Firm*—Marshall, O'Toole, Gerstein, Murray & Bicknell

[57] ABSTRACT

Dual-rod cigarette manufacturing machine on which two streams of tobacco, held by suction on to parallel conveyor belts, are subjected, prior to being wrapped in strip cigarette paper, to the action of respective shaving devices each consisting of two tangent counter-rotating discs with cutting edges. On each shaving device, the disc outside the clearance between the two streams is flat, whereas the disc inside the clearance is truncated-cone-shaped and arranged in such a manner that its generating line through the point of tangency with the flat disc is coplanar with the latter. There can be vertical and horizontal adjustment of each shaving device.

3 Claims, 3 Drawing Figures

DUAL-ROD CIGARETTE MANUFACTURING MACHINE

BACKGROUND OF THE INVENTION

The present invention relates to a dual-rod cigarette manufacturing machine and, in particular, to devices used on such machines for shaving streams of shredded tobacco for forming, after wrapping, continuous cigarette rods.

The machine described in U.S. Pat. No. 4,336,812 of G.D. S.p.A., is designed to form two streams or layers of tobacco by accumulating single tobacco particles underneath respective supports consisting of parallel-moving suction conveyor belts.

Each stream of tobacco, as it is carried on its respective conveyor belt to cigarette forming means, is subjected to a shaving operation for ensuring essentially constant height and thickness of the stream. On single-rod cigarette manufacturing machines, the means employed for this purpose, known as shavers, consist of two identical, coplanar discs mounted on vertical, counter-rotating axes, the discs having cutting edges and being tangent with each other along the course of the tobacco stream.

Insufficient space is available for assembling the aforementioned shavers on dual-rod cigarette manufacturing machines on which the clearance between the two streams of tobacco, held on to their respective conveyor belts, is extremely limited and, being determined by specific construction requirements, not readily alterable. To be more precise, if a shaver of the aforementioned type were to be assigned to each of the two streams of tobacco, the disc located between the two conveyor belts would interfere with the course of the second stream, thus obstructing supply to the cigarette forming means.

For this reason, the shaving devices on dual-rod cigarette manufacturing machines, according to U.S. Pat. No. 4,304,243 of G.D. S.p.A., consist of pairs of identical, trucated-cone discs mounted on a slant and converging downwards.

The discs are arranged with the large-end cutting edges tangent and the generating lines aligned with the direction of the respective tobacco stream.

Consequently, the discs on each shaver are inclined downwards from the point of contact with their respective tobacco stream, thus eliminating any interference between the second stream and the disc facing it.

It has been found, however, that, over and above a given disc angle on the shaver, the tobacco stream encounters difficulty in working its way between the discs, with the result that it is only partly or unevenly shaved.

SUMMARY OF THE INVENTION

The present invention provides a shaving device designed to overcome the drawbacks involved in the current state of the art, i.e. one designed to ensure efficient shaving of its assigned tobacco stream without interfering in any way with the second stream. The present invention pertains to a dual-rod cigarette manufacturing machine comprising means for forming two continuous streams of tobacco, essentially-parallel, coplanar conveyor belts for transferring the tobacco streams to an unloading point and, along the route of each of the two belts, a tobacco stream shaving device consisting of a pair of counter-rotating discs located respectively inside and outside the clearance between the tobacco streams, having respective cutting edges and arranged with the edges essentially tangent along the course of the respective tobacco stream, characterised by the fact that, on each shaving device, the disc outside the clearance between the tobacco streams is essentially flat with its axis essentially perpendicular to the plane of the belts, whereas the disc inside the clearance between the tobacco streams is mounted on a slant in relation to the plane and converging, on the opposite side to the tobacco streams, with the axis of the flat disc.

BRIEF DESCRIPTION OF THE DRAWINGS

The present invention will now be described with reference to the attached drawings in which.

DETAILED DESCRIPTION OF THE INVENTION

Figure 1:
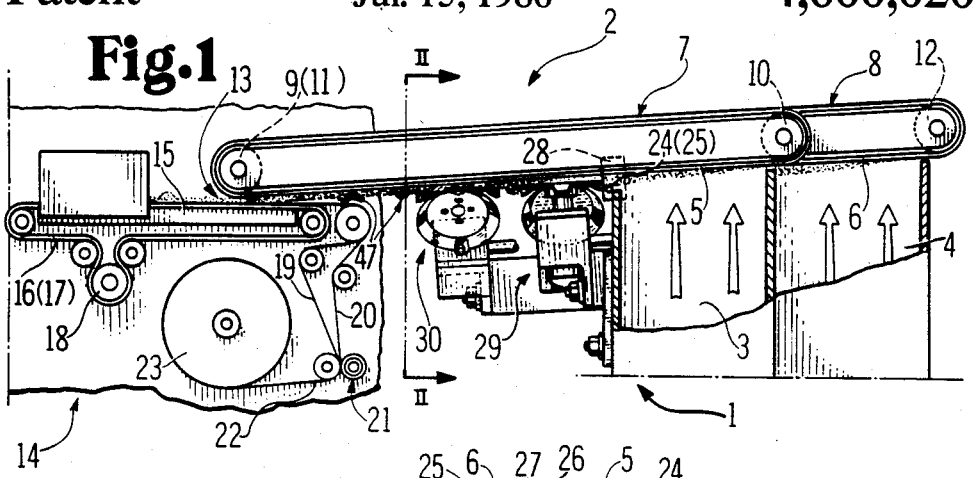
FIG. 1 shows a dual-rod cigarette manufacturing machine fitted with a device according to the present invention.

Number 1 in FIG. 1 indicates the base of a dual-rod cigarette manufacturing machine indicated as a whole by 2. Numbers 3 and 4 indicate, from left to right, two ducts supplied at the bottom ends, by means not shown, with a continuous stream of tobacco particles.

The particles, forced by an upward-moving current of air generated by a compressed air source not shown, flow up the two ducts 3 and 4 as far as the bottom branches 5 and 6 of respective suction conveyor belts 7 and 8. The belts 7 and 8 are looped round end rollers numbered respectively 9, 10 and 11, 12 from left to right. End rollers 9 and 11, coaxial and powered so as to turn clockwise, are arranged lower down as compared with rollers 10 and 12, so that the bottom branches 5 and 6 slope downwards in the travelling direction.

The two bottom branches 5 and 6, which, as stated, close off the outlets on ducts 3 and 4, extend leftwards as far as a so-called unloading point 13 where the tobacco is fed into a section 14 of machine 2.

Unloading point 13 is located at the junction of the branches 5 and 6 and the top branches, running over horizontal top 15, of two belts 16 and 17 (only one of which is shown in FIG. 1), the belts 16 and 17 being arranged in loop formation and powered by counter-clockwise-rotating roller 18.

Numbers 19 and 20 indicate two strips of cigarette paper produced by cutting lengthwise, by means of rotary cutter 21, a single strip 22 run off reel 23.

Figure 2:
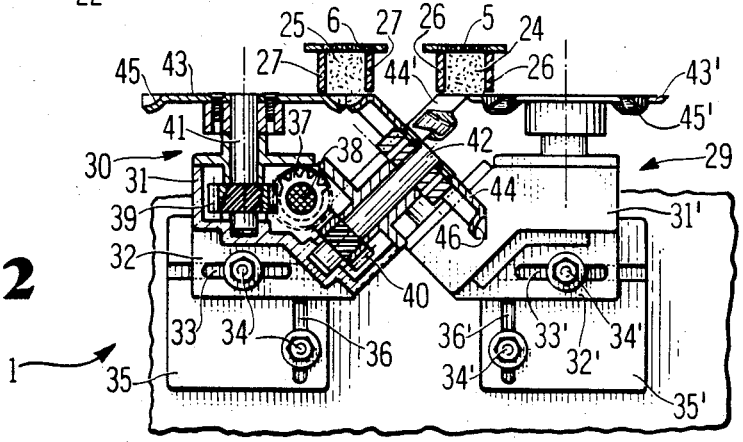
FIG. 2 shows a larger-scale section along line II—II in FIG. 1 of the device according to the present invention.
Figure 3:
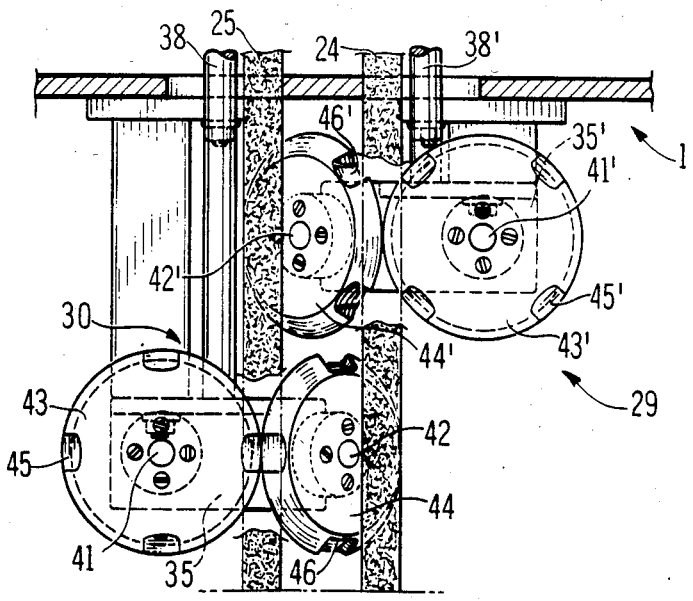
FIG. 3 shows a plan view of the device according to the present invention.

Ducts 3 and 4 provide for accumulating single tobacco particles into continuous tobacco streams 24 and 25 on suction branches 5 and 6 respectively (as shown also in FIGS. 2 and 3).

At the unloading point 13, the said streams 24 and 25 are deposited on to strips 19 and 20 respectively. As they travel over top 15, the strips 19 and 20 are forced, by guide means not shown, to wrap gradually round tobacco streams 24 and 25, so as to form two continuous cigarette rods later cut into separate cigarettes.

As shown also in FIG. 2, outside ducts 3 and 4 and upstream from the unloading point 13, tobacco streams 24 and 25, held by suction on to respective branches 5 and 6 and bordered laterally by respective walls 26 and 27, are tested as to air permeability by a device 28 and then shaved by shaving devices indicated as a whole by 29 and 30 respectively.

As the shaving devices are essentially identical, only device 30 will be dealt with in the following description. In FIGS. 2 and 3, the corresponding component parts on shaver 29 will be indicated by the same numbers as on shaver 30 plus an apostrophe.

Shaving device 30 comprises a box body or support 31 supported by base 1 on manufacturing machine 2.

The said box body 31 is fitted at the bottom with an appendix 32 having a horizontal slot 33 fitted through with fastening means 34 inserted inside a plate 35.

The latter is, in turn, provided with a vertical slot 36 fitted through with fastening means 34 inserted inside base 1 on manufacturing machine 2.

The said slots 33 and 36 provide for both horizontal and vertical adjustment of shaving device 30 in relation to tobacco stream 25.

Inside box body 31, provision is made for a gear 37 mounted on a horizontal shaft 38 connected, by drive means not shown, to means for powering manufacturing machine 2. Gear 37 engages with two gears, 39 and 40, the first fitted on to the bottom end of vertical shaft 41 and the second on to the bottom end of sloping shaft 42.

The top ends of shafts 41 and 42, outside box body 31, are fitted with two discs 43 and 44 tangent with each other along the course of tobacco stream 25 and turning in opposite directions by virtue of the connection already mentioned.

In more detail, disc 43 on vertical shaft 41 is essentially flat in shape, whereas disc 44 on shaft 42 is of truncated-cone shape and inclined so that its generating line through the point of tangency with disc 43 is essentially coplanar with the latter.

Flat disc 43 is provided round the edge with equally-spaced recesses or grooves 45 which, when the shaving device is operated, mate with recesses or grooves 46 on the truncated-cone surface of disc 44.

The spacing between grooves 45 and 46 is essentially equal to the length of a cigarette.

By virtue of the combined action of discs 43 and 44 provided with grooves 45 and 46, tobacco stream 25 is shaped in such a manner as to alternate sections of essentially uniform thickness with thicker sections numbered 47 and spaced by the length of one cigarette.

According to known technology, once the tobacco streams 24 and 25 are wrapped inside strips 19 and 20 for forming the so-called continuous cigarette rods, cutting the rods at the said thicker sections produces cigarettes equal in length to the spacing and having greater tobacco density at the end as compared with the middle.

The denser tobacco sections are known to produce single cigarettes with compact ends better suited to withstanding subsequent production stages (filter assembly and packing) with no noticeable loss of tobacco.

Should manufacturing machine 2 need to be adapted for producing cigarettes of different length, the two pairs of discs 43, 44 and 43', 44' are replaced by discs having edge grooves 45, 46 and 45', 46' the spacing of which is essentially equal to the length of the cigarettes to be produced.

After assembling the new discs on shafts 41, 42 and 41', 42', box bodies 31 and 31' must be adjusted horizontally and vertically so as to reset the two shavers 30 and 29 in relation to tobacco streams 25 and 24.

As clearly shown in the foregoing description, unlike known types of shaving devices, the truncated-cone disc between the two tobacco streams on each shaving device according to the present invention, while providing for an angle in no way interfering with the course of the second tobacco stream, defines a sufficiently wide angle with the outer disc to ensure the tobacco stream is in no way prevented from working its way between the two discs.

We claim:

1. A dual-rod cigarette manufacturing machine (2) comprising means (3, 4) for forming two continuous streams of tobacco (24, 25), essentially-parallel, coplanar conveyor belts (5, 6) for transferring the tobacco streams (24, 25) to an unloading point (13) and, along the route of each of the two belts (5, 6), a tobacco stream (24, 25) shaving device (29, 30) consisting of a pair of counter-rotating discs (43', 44'; 43, 44) located respectively inside and outside the clearance between the tobacco streams (24, 25), having respective cutting edges and arranged with the edges essentially tangent along the course of the respective tobacco stream (24, 25), characterized in that, on each shaving device (29, 30), the discs (45', 45) outside the clearance between the tobacco streams (24, 25) is essentially flat with its axis essentially perpendicular to the plane of the belts (5, 6), whereas the discs (44', 44) inside the clearance between the tobacco streams (24, 25) is mounted on a slant in relation to the plane and converging, on the side opposite to the tobacco streams (24, 25), with the axis of the flat discs (45', 45).

2. A dual-rod cigarette manufacturing machine (2) according to claim 1, characterized in that each of the discs (44', 44) inside the clearance between the tobacco streams (24, 25) is of essentially truncated-cone shape, is provided with the cutting edge on its larger end and arranged so that its generating line through the point of tangency with the edge of the flat discs (45', 45) is essentially coplanar with the latter.

3. A dual-rod cigarette manufacturing machine (2) according to claim 1 comprising means (33–36; 33'–36') enabling both vertical and horizontal adjustment of the shaving devices (29, 30) in relation to the tobacco streams (24, 25).

* * * * *